US009282771B2

(12) United States Patent
Figueroa

(10) Patent No.: US 9,282,771 B2
(45) Date of Patent: Mar. 15, 2016

(54) ASHTRAY SYSTEM

(71) Applicant: Hector F. Figueroa, Elgin, IL (US)

(72) Inventor: Hector F. Figueroa, Elgin, IL (US)

( * ) Notice: Subject to any disclaimer, the term of this patent is extended or adjusted under 35 U.S.C. 154(b) by 37 days.

(21) Appl. No.: 14/327,350

(22) Filed: Jul. 9, 2014

(65) Prior Publication Data

US 2015/0020820 A1 Jan. 22, 2015

Related U.S. Application Data

(60) Provisional application No. 61/844,270, filed on Jul. 9, 2013.

(51) Int. Cl.

| | |
|---|---|
| ***A24F 15/08*** | (2006.01) |
| ***A24F 19/10*** | (2006.01) |
| ***A24F 13/24*** | (2006.01) |
| ***G04B 47/02*** | (2006.01) |
| ***G04B 45/00*** | (2006.01) |
| ***G04B 19/10*** | (2006.01) |

(52) U.S. Cl.

CPC ..... *A24F 19/10* (2013.01); *A24F 13/24* (2013.01); *A24F 15/08* (2013.01); *G04B 19/106* (2013.01); *G04B 45/0069* (2013.01); *G04B 47/02* (2013.01)

(58) Field of Classification Search

CPC ... A24F 19/0035; A24F 19/10; A24F 19/105; A24F 19/12; A24F 15/08; A24F 15/10

USPC ..... 131/231–242.6

See application file for complete search history.

(56) References Cited

U.S. PATENT DOCUMENTS

| | | | | | |
|---|---|---|---|---|---|
| D68,577 | S | * | 10/1925 | Guinn | D21/350 |
| 3,566,882 | A | * | 3/1971 | Schroeder | A24F 19/10 108/26.2 |
| 4,403,700 | A | * | 9/1983 | Manlove | B43M 99/008 211/88.01 |
| 4,595,905 | A | * | 6/1986 | May | A24F 19/10 131/231 |
| D295,450 | S | * | 4/1988 | Iacovelli | D10/2 |
| 4,996,995 | A | * | 3/1991 | Kojima | A24F 19/0042 131/231 |
| 2003/0176144 | A1 | * | 9/2003 | Fisher | A63H 33/26 446/133 |

* cited by examiner

*Primary Examiner* — Anthony Calandra
(74) *Attorney, Agent, or Firm* — Ruth Eure; Emery L. Tracy

(57) ABSTRACT

An ashtray system for a cigarette, cigars, and pipes is provided. The ashtray system comprises a base with a clock tower secured to the base and extending in a general direction away from the base. A clock is mounted in the clock tower. A pair of ashtrays are formed in the base. A plurality of cigarette/cigar holders are formed in the base for holding cigarettes/cigars in a substantially vertical position with each holder extending into at least one of the ashtrays. A plurality of apertures are formed in the base for holding cigarettes/cigars in a substantially vertical position. At least one storage area is formed for holding a pack of cigarettes, a pipe, tobacco, or several cigars. At least one drawer compartment is formed for holding a cigar-cutter; a pipe-tamper and cleaner; and lighters.

14 Claims, 3 Drawing Sheets

ASHTRAY SYSTEM

The present application claims the benefit of priority of provisional patent application Ser. No. 61/844,270, filed on Jul. 9, 2013, entitled "Ashtray".

BACKGROUND OF THE INVENTION

1. Field of the Invention

This invention relates generally to an ashtray system and, more particularly, the invention relates to an ashtray system providing the cigarette, pipe, or cigar smoker with a convenient and good-looking ashtray, but also serving as a table-top clock and an easily accessed storage locker or small-scale cabinet for cigarettes, cigars, or pipes, matches or lighters; and the instruments such as cigar-cutters and pipe-tampers that serve as necessary adjuncts to the smoking of pipes and cigars.

2. Description of the Prior Art

Almost 60 million American adults smoke cigarettes, cigars, or pipes; and that worldwide, about 30 percent of adult males, and an unspecified number of adult females, smoke tobacco. Worldwide, more than 10 million cigarettes are sold every minute.

SUMMARY

The present invention is an ashtray system for a cigarette, cigars, and pipes. The ashtray system comprises a base having a top surface, a bottom surface, a first side surface, a second side surface substantially opposite the first side surface, a front surface, and a rear surface substantially opposite the front surface. A clock tower having a first end and a second end is provided with the first end secured to the top surface of the base and the clock tower extending in a general direction away from the top surface of the base. A clock is mounted in the clock tower. A pair of ashtrays are formed in the top surface of the base. A plurality of cigarette/cigar holders are formed in the top surface of the base for holding cigarettes/cigars in a substantially vertical position with each holder extending into at least one of the ashtrays. A plurality of apertures are formed in the top surface of the base for holding cigarettes/cigars in a substantially vertical position. At least one storage area is formed between the surfaces with the at least one storage area sized and shaped for holding a pack of cigarettes, a pipe, tobacco, or several cigars. At least one drawer compartment is formed between the surfaces with the at least one drawer compartment sized and shaped for holding a cigar-cutter; a pipe-tamper and cleaner; and lighters.

DETAILED DESCRIPTION OF THE PREFERRED EMBODIMENTS

Figure 2:
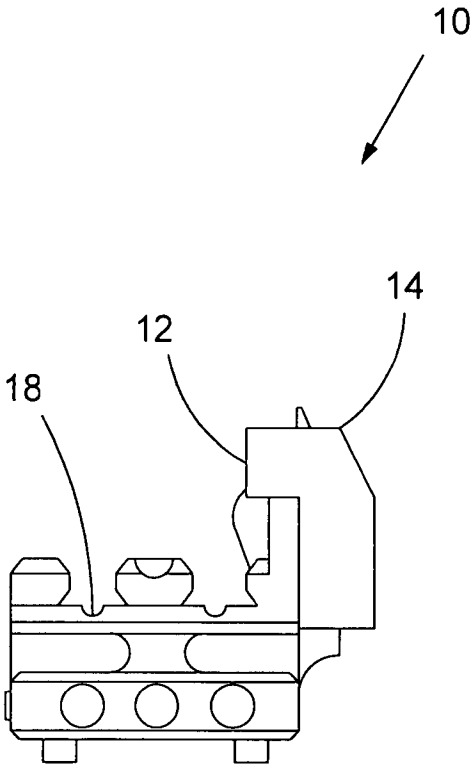
FIG. 2 is an elevational side view illustrating the ashtray system, constructed in accordance with the present invention.
Figure 1:
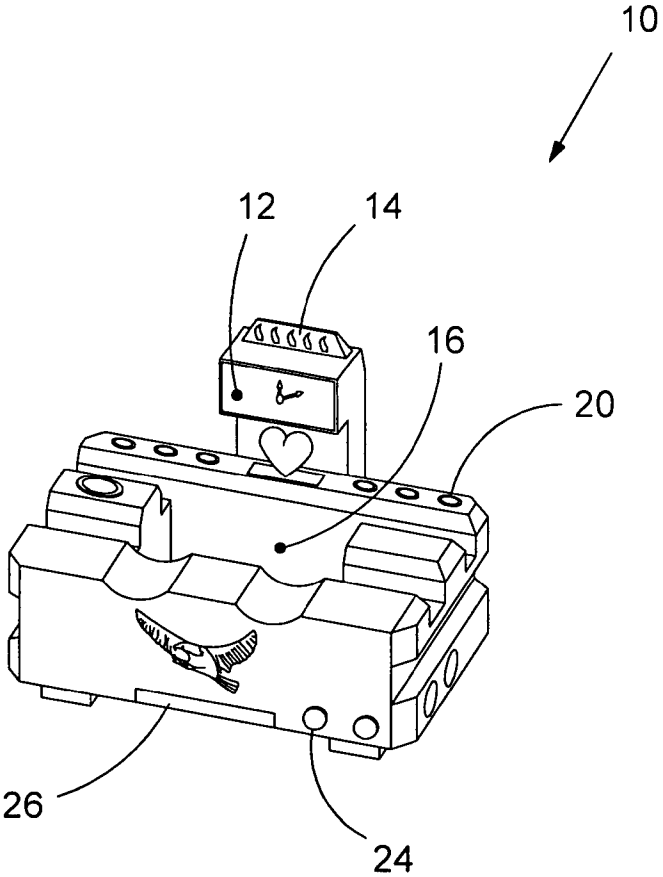
FIG. 1 is a perspective view illustrating an ashtray system, constructed in accordance with the present invention.
Figure 4:
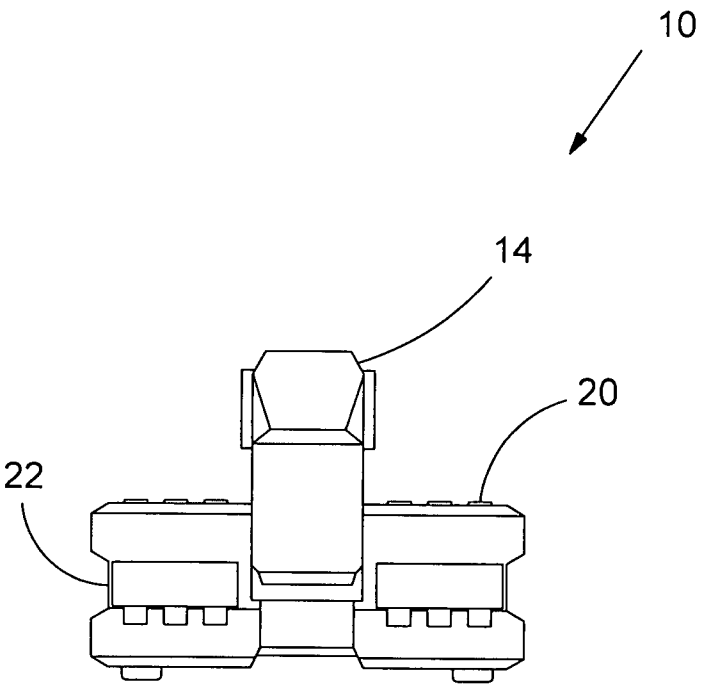
FIG. 4 is a rear plan view illustrating the ashtray system, constructed in accordance with the present invention.
Figure 3:
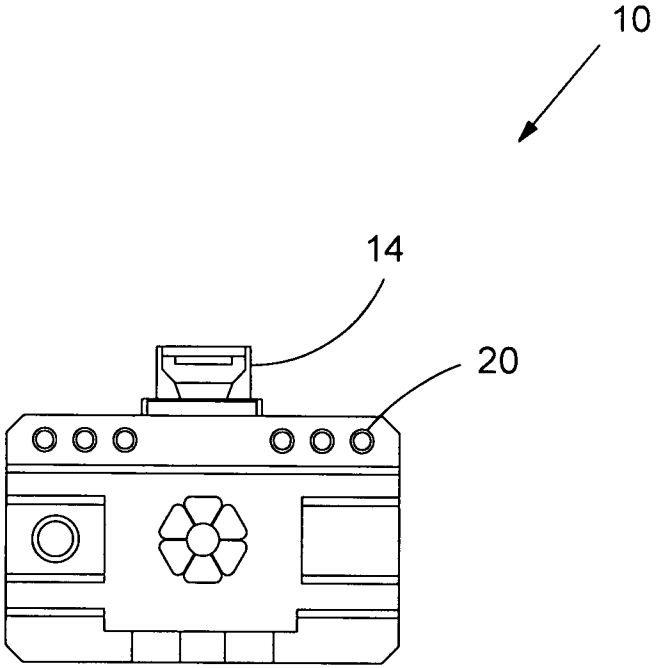
FIG. 3 is a bottom plan view illustrating the ashtray system, constructed in accordance with the present invention.
Figure 6:
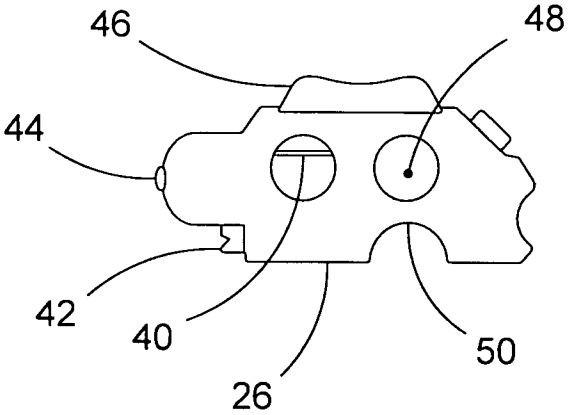
FIG. 6 is an elevational side view illustrating a cigar system of the ashtray system, constructed in accordance with the present invention.
Figure 5:
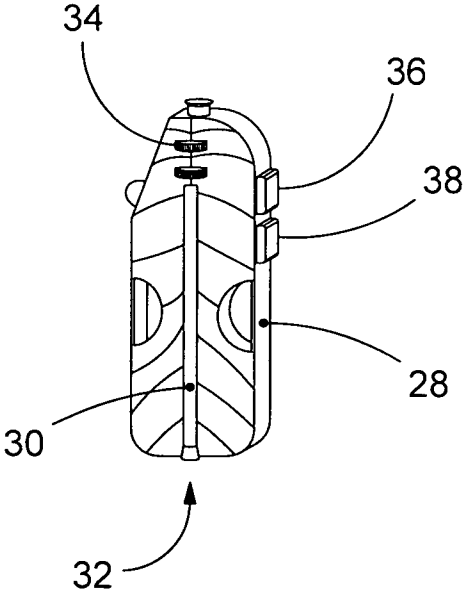
FIG. 5 is a perspective view illustrating a lighter system of the ashtray system, constructed in accordance with the present invention.

As illustrated in FIGS. 1-6, the present invention is an ashtray system, indicated generally at 10, providing the cigarette, pipe, or cigar smoker with a convenient and good-looking ashtray, but also serving as a table-top clock and an easily accessed storage locker or small-scale cabinet for cigarettes, cigars, or pipes, matches or lighters; and the instruments such as cigar-cutters and pipe-tampers that serve as necessary adjuncts to the smoking of pipes and cigars.

The ashtray system 10 of the present invention is preferably fabricated of a glass material and measures approximately three (3") inches in height by approximately eight (8") inches in width and approximately four (4") inches in depth, and the overall impression of the ashtray system 10 is elegant and stately preferably being Victorian in styling, and culminating in a pedestal-style clock 12 with a Roman-numeral face. Solid and stable in construction, the clock 12 appears to rise like an old-fashioned clock tower 14 from the broader, pedestal-style base of the ashtray system 10.

At the base of the ashtray system 10 of the present invention, on either side of the clock 12, are a pair of ashtrays 16 fashioned with a series of cigarette, pipe, or cigar holders 18, i.e., semicircular grooves or notches, around the sides. Additional cylindrical borings 20 in the surface of the ashtray system 10 function as individual holders for fresh cigarettes. Beneath the ashtrays 16, the ashtray system 10 forms a sort of storage cabinet for a smoker's materials and accessories with drawers containing spacious compartments 22 for a pack of cigarettes, a pipe and tobacco, or several cigars. There will also be drawer compartments 24 for the tools and accessories a smoker requires, such as a cigar-cutter 26; a pipe-tamper and cleaner; and lighters 28. Several versions and styles of the ashtray system 10 can be produced. A "standard" or "economy" version, for example, might include merely the compartments for the accessories mentioned; while a "deluxe" or "premium" version might actually include the lighter system 28, pipe tools, and cigar cutter system 26, as well. Additionally, the lighter system 28 and cigar cutter system 26 can be incorporated as integral features built into the ashtray system 10 itself. In a preferred embodiment, the lighter system 28 has a visible fluid level container 30, a fluid refill hole 32, a torch control dial 34, a cigar button 36 for lighting cigars, and a cigarette button 38 for lighting cigarettes. In a preferred embodiment, the cigar cutter system 26 has a cigar cutter blade 40, a paper cutter 42, a flashlight 44, a cigar cutter button 46, a finger holder 48, and a finger rest 50.

Further possibilities for the ashtray system 10 of the present invention include choosing a variety of materials from inexpensive, injection-molded thermoplastic to fine marble for the ashtray; and producing the ashtray in a variety of heights, widths, and styles from ornate and Victorian to art-deco and futuristic. Thus, while the look of the ashtray system 10 can be varied to appeal to the tastes and decors of various users, the function of the ashtray remains the same.

The ashtray system 10 of the present invention is an attractive and highly useful addition to the home of any smoker who enjoys a cigarette, pipe, or cigar. Featuring a classic, battery-powered table-top clock integrated into a single-piece unit containing everything a smoker might need, from his or her own smoking materials of preference to a pair of ashtrays 16, to the tools and accessories that he or she requires, the ashtray system 10 is the perfect complement for any end-table, coffee table, or a bookcase or table beside an easy chair.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. An ashtray system for a cigarette, cigars, and pipes, the ashtray system comprising:

a base having a top surface, a bottom surface, a first side surface, a second side surface substantially opposite the first side surface, a front surface, and a rear surface substantially opposite the front surface;

to a clock tower having a first end and a second end, the first end secured to the top surface of the base, the clock tower extending in a general direction away from the top surface of the base;

a clock mounted in the clock tower;

a pair of ashtrays formed in the top surface of the base;

a plurality of cigarette/cigar holders formed in the top surface of the base for holding cigarettes/cigars in a substantially vertical position, each holder extending into at least one of the ashtrays;

a plurality of apertures formed in the top surface of the base for holding cigarettes/cigars in a substantially vertical position;

at least one storage area formed between the surfaces, the at least one storage area sized and shaped for holding a pack of cigarettes, a pipe, tobacco, or several cigars; and at least one drawer compartment formed between the surfaces, the at least one drawer compartment sized and shaped for holding a cigar-cutter; a pipe-tamper and cleaner; and lighters.

2. The ashtray system of claim 1 wherein the base is constructed from a glass material.

3. The ashtray system of claim 1 wherein the base and clock tower measures approximately three (3") inches in height by approximately eight (8") inches in width and approximately four (4"), inches in depth.

4. The ashtray system of claim 1 wherein the clock mounted within the clock tower is a pedestal-style clock with a Roman-numeral face.

5. The ashtray system of claim 1 wherein the clock is mounted nearingly adjacent the second end of the clock tower.

6. The ashtray system of claim 1 wherein the clock tower is positioned between pair of ashtrays.

7. The ashtray system of claim 1 wherein the holders are configured as semicircular grooves or notches.

8. The ashtray system of claim 1 and further comprising:

a lighter system having a visible fluid level container, a fluid refill hole, a torch control dial, a cigar button for lighting cigars, and a cigarette button for lighting cigarettes.

9. The ashtray system of claim 1 and further comprising:

a cigar cutter system having a cigar cutter blade, a paper cutter, a flashlight, a cigar cutter button, a finger holder, and a finger rest.

10. An ashtray system for a cigarette, cigars, and pipes, the ashtray system comprising:

a base having a top surface, a bottom surface, a first side surface, a second side surface substantially opposite the first side surface, a front surface, and a rear surface substantially opposite the front surface;

a clock tower having a first end and a second end, the first end secured to the top surface of the base, the clock tower extending in a general direction away from the top surface of the base;

a clock mounted in the clock tower nearingly adjacent the second end of the clock tower;

a pair of ashtrays formed in the top surface of the base, the clock tower positioned between the ashtrays;

a plurality of cigarette/cigar holders formed in the top surface of the base for holding cigarettes/cigars in a substantially vertical position, each holder extending into at least one of the ashtrays;

a plurality of apertures formed in the top surface of the base for holding cigarettes/cigars in a substantially vertical position;

at least one storage area formed between the surfaces, the at least one storage area sized and shaped for holding a pack of cigarettes, a pipe, tobacco, or several cigars;

at least one drawer compartment formed between the surfaces, the at least one drawer compartment sized and shaped for holding a cigar-cutter; a pipe-tamper and cleaner; and lighters;

a lighter system having a visible fluid level container, a fluid refill hole, a torch control dial, a cigar button for lighting cigars, and a cigarette button for lighting cigarettes; and a cigar cutter system having a cigar cutter blade, a paper cutter, a flashlight, a cigar cutter button, a finger holder, and a finger rest.

11. The ashtray system of claim 10 wherein the base is constructed from a glass material.

12. The ashtray system of claim 10 wherein the base and clock tower measures approximately three (3") inches in height by approximately eight (8") inches in width and approximately four (4") inches in depth.

13. The ashtray system of claim 10 wherein the clock mounted within the clock tower is a pedestal-style clock with a Roman-numeral face.

14. The ashtray system of claim 10 wherein the holders are configured as semicircular grooves or notches.

* * * * *